United States Patent [19]

Gelinas, Jr.

[11] Patent Number: 4,752,076

[45] Date of Patent: Jun. 21, 1988

[54] APPARATUS FOR PROVIDING ENTERTAINMENT AND METHODS OF USING SAME

[76] Inventor: Robert C. Gelinas, Jr., 493 Gregory La., West Chester, Pa. 19380

[21] Appl. No.: 60,226

[22] Filed: Jun. 10, 1987

Related U.S. Application Data

[63] Continuation-in-part of Ser. No. 855,938, Apr. 15, 1986, abandoned.

[51] Int. Cl.[4] ..... A63B 67/00

[52] U.S. Cl. ..... 273/318; 273/109

[58] Field of Search ..... 273/318, 322, 326, 109, 273/412; 403/330

[56] References Cited

U.S. PATENT DOCUMENTS

| | | | |
|---|---|---|---|
| 973,935 | 10/1910 | George | 273/318 |
| 1,022,186 | 4/1912 | Engler | 273/322 |
| 1,816,642 | 7/1931 | Fetter | 40/330 |

FOREIGN PATENT DOCUMENTS

| | | | |
|---|---|---|---|
| 140771 | 2/1935 | Austria | 273/322 |

*Primary Examiner*—William H. Grieb

*Attorney, Agent, or Firm*—Hill, Van Santen, Steadman & Simpson

[57] ABSTRACT

A hand manipulated stick provides at least two parallel spaced apart rails extending longitudinally from a handle and affords inherently unstable point contact with a spherical ball so that the contact may be selectively rendered more or less stable by the exercise of skill and dexterity of the user in various levels of accomplishment.

27 Claims, 4 Drawing Sheets

114

14
12
10
20
18
16
22

118
120

12
18
20
10

214

218
220
216
214
210
210
216
220
218
222

220
218
226
214
210

318
314
321
320
322

316
314
321
318
310
322
320

414
410
12

420
418
421
425
416
410
423
414
420
422
462
421
418
432
452
425
423
416
442

APPARATUS FOR PROVIDING ENTERTAINMENT AND METHODS OF USING SAME

RELATED APPLICATIONS

This is a continuation-in-part of U.S. Patent Application Ser. No. 855,938, filed Apr. 15, 1986, and copending herewith, now abandonded.

BACKGROUND OF THE INVENTION

The present invention relates generally to apparatus for providing entertainment to the user. More specifically, the present invention relates to apparatus for tossing, manipulating and catching a ball and methods of playing same.

There are a variety of apparatus that cooperate with a ball, or other object, and allow one to play a game. A classic example of such an apparatus would be the baseball glove and baseball. Although there are many variations to the game of "catch", it can become redundant and boring. Moreover, typically it is not advisable to play catch indoors.

Accordingly, there is a need for a new game that improves the game of catch, particularly one that can be practiced singly, or may also be played simultaneously with another player.

SUMMARY OF THE INVENTION

The present invention provides an apparatus for providing entertainment comprising an object member and an elongated member. The elongated member includes a handle and at least two rail members for tossing, manipulating, and catching the object member. The object member and elongated member cooperate so that the object member can be selectively supported and moved on the rail members and tossed and caught by the rail members, all with varying degrees of dexterity and skill.

The elongated member is so constructed and arranged that there are no stops or rest positions for the object member on the elongated member as it is supported by the rail members. Accordingly, the object member can roll off either a front or rear end of the elongated member.

In a preferred embodiment, the elongated member includes a body member that defines the rail members, and the rail members cooperate to support the object member above the remaining portions of the body member. Preferably, the object member is a ball.

In another preferred embodiment, the rail members provide a plurality of support planes for supporting the ball member.

The present invention also provides a method of play comprising the steps of providing an elongated member having a handle and at least two rail members that define a manipulation surface which functions as a tossing, manipulating and catching surface or a support and rolling surface and an object ball, the rail members cooperating to support the ball. Preferably, the method includes the steps of tossing the ball member in the air or to another player or against a deflection surface and catching the ball on the tossing, manipulating and catching surface defined by the rail members.

It is an advantage of the present invention to provide an apparatus for providing a method of entertainment.

Furthermore, an advantage of the present invention is to provide an elongated member that is constructed so that there are no stops or rest positions for a ball supported by rail members of the elongated member, thereby allowing the object member to roll off either a front or rear end of the elongated member.

Moreover, it is an advantage of the present invention to provide a method of playing a game.

Another advantage of the present invention is to provide an elongated member having two rails that define a manipulative catching and tossing surface for catching, manipulating and tossing a ball member.

A further advantage of the present invention is to provide an elongated member and ball member that can be utilized to play a game.

An additional advantage of the present invention is that it provided an apparatus for playing a game that allows one to play either alone or with two or more people.

Furthermore, an advantage of the present invention is that it provides an apparatus for playing a game that can either be played indoors, such as in a house or an office or outdoors.

A still further advantage of the present invention is that it provides an apparatus that when used may produce a relaxing effect.

Moreover, an advantage of the present invention is that it provides an apparatus for playing a game that is small enough that it can easily be taken anywhere one would want to play the game.

Additional features and advantages are described in, and will be apparent from, the detailed description of the presently preferred embodiments and from the drawings.

DETAILED DESCRIPTION OF THE PRESENTLY PREFERRED EMBODIMENTS

The present invention provides an elongated member 10 that can be utilized with an object member 12 to provide a method of entertainment. Moreover, the present invention provides methods of playing a game with the elongated member 10 and object member 12 of the present invention.

Figures 1, 2, 3, 4, 5, 6, 7, 8, 9, 10, 11:
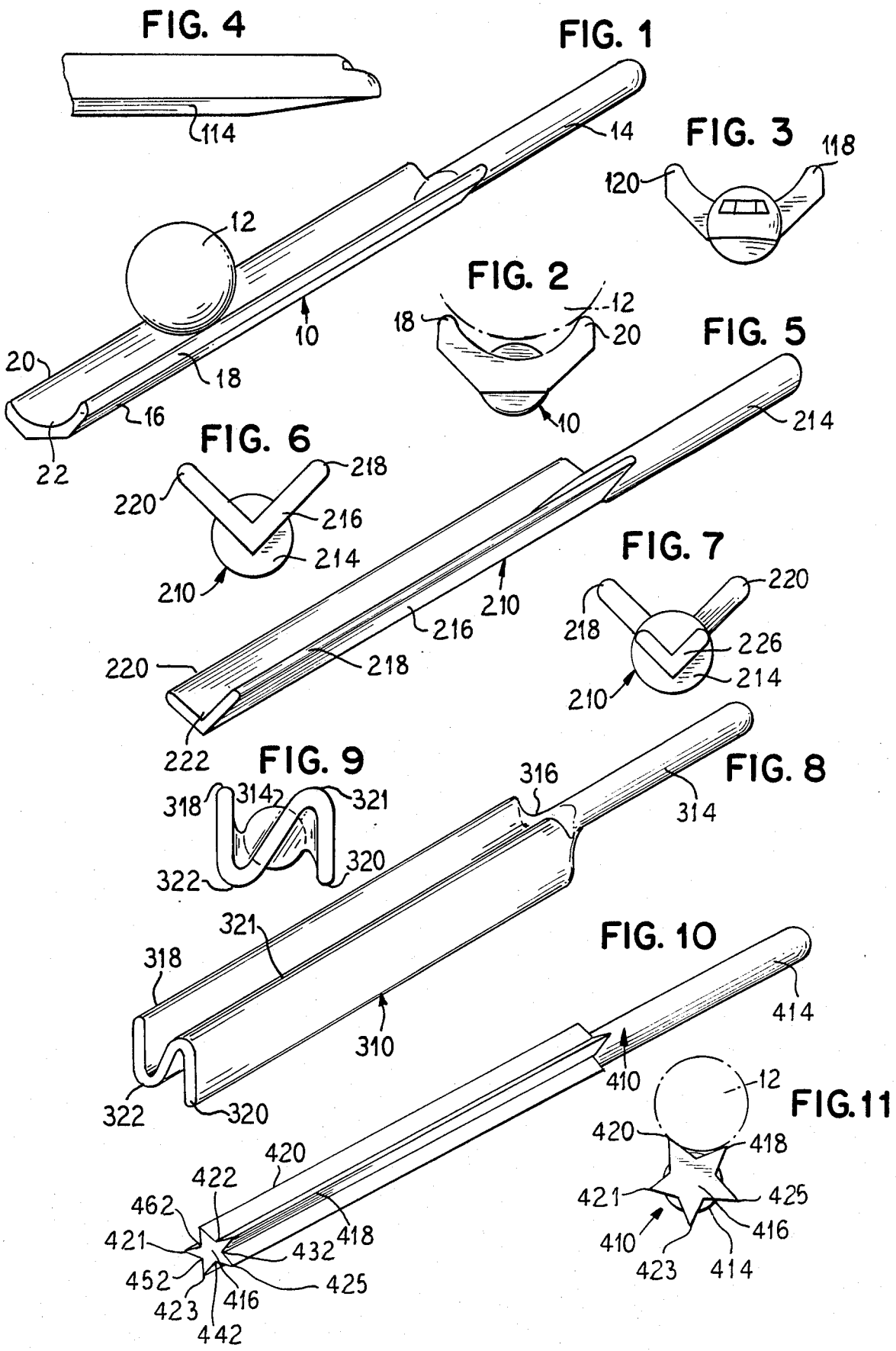
FIG. 1 illustrates a top elevational view of a preferred embodiment of the elongated member and ball member of the present invention.
FIG. 2 illustrates a front view of the elongated member and ball member of FIG. 1.
FIG. 3 illustrates a back view of a further embodiment of the elongated member of the present invention.
FIG. 4 illustrates a side view of a portion of the apparatus of FIG. 3.
FIG. 5 illustrates a top elevational view of another preferred embodiment of the elongated member of the present invention.
FIG. 6 illustrates a front view of the elongated member of FIG. 5.
FIG. 7 illustrates a back view of the elongated member of FIG. 5.
FIG. 8 illustrates another preferred embodiment of the elongated member of the present invention.
FIG. 9 illustrates a front view of the apparatus of FIG. 8.
FIG. 10 illustrates a top elevational view of another preferred embodiment of the elongated member of the present invention.
FIG. 11 illustrates a front view of the apparatus of FIG. 10 with a ball member.

FIG. 1 illustrates a preferred embodiment of the elongated member 10 of the present invention. As illustrated, the elongated member 10 includes a handle 14 and a body member 16 extending from the handle 14. The body member 16 includes two rails 18 and 20 and a base portion 22.

The rail members 18 and 20 are constructed so that they can support an object member such as a ball 12. Thus, in engineering vernacular, the rails are straight, not tapered or curved, form spaced parallel lines of support affording rolling point contact with the peripheral surface of the ball. Preferably, the ball 12 is supported above the base member 22 on the rails 18 and 20. Accordingly, the ball 12 can freely move forward and backward along the rails 18 and 20 in response to tilting of the member 10. There is a certain amount of inherent instability between the ball and the rails because of the limited 2-point contact, thereby challenging the user to coordinate the position of the stick or wand or elongated member 10 relative to the center of gravity of the spherical ball through the exercise of appropriate manual dexterity.

The rails 18 and 20 are disposed in a common support plane in which the ball 12 is rollably supported. As used herein, support plane means the plane in which the ball may travel and/or be supported by the rails 18 and 20. Moreover, as discussed below, the rails define a manipulative surface that functions as a tossing, manipulating and catching surface for tossing and catching the ball member 12 or for selectively supporting the ball stationarily or for rolling the ball to and fro. The tossing, manipulating and catching surface is defined as the portions of the rails 18 and 20 on which the ball member 12 can be supported and tossed and caught.

The handle 14 allows one to toss the ball into the air by exerting an upward or downward movement with the handle. The handle also allows one to maneuver the elongated member 10 to catch the ball of the rails 18 and 20. Moreover, the handle allows one to rotate the elongated member 10 or to tilt the elongated member 10 so that the ball travels back and forth along the rails 18 and 20.

As illustrated in FIG. 2, the ball 12 is preferably supported by the rails 18 and 20 so that it does not rest on the base member 22. Because of this construction the ball 12 can easily roll along the rails 18 and 20 back and forth. Accordingly, preferably the distance between rails 18 and 20 is less than the diameter of the ball 12 that is to be supported. By varying the distance between the rails 18 and 20 the difficulty in maintaining the ball 12 on the rails 18 and 20 and/or catching the ball can be increased or decreased.

As illustrated, in all of the embodiments of the present invention, the elongated member 10, and specifically the support plane defined by the rails 18 and 20 does not include any stop or rest positions for the ball 12. Accordingly, the ball 12 can roll off either a front or a rear end of the elongated member 10. Likewise, because the rails 18 and 20 are straight and parallel to each other throughout their length, and not tapered or curved, the difficulty in maintaining the ball 12 or the rails is constant throughout the length of the support plane.

FIGS. 3 and 4 illustrate a preferred embodiment of the apparatus of FIG. 1. In this embodiment, the handle member 114 includes some decorative or ornamental type shape. As illustrated, the handle member 114 can be shaped like the space shuttle. Accordingly, as illustrated in FIG. 3, when viewed from a back side view the elongated member 10 looks like a replica of the shuttle. Of course, other shapes and constructions can be utilized and other ornamental designs can be created for the handle 14.

FIG. 5 illustrates another preferred embodiment of the elongated member 210 of the present invention. Similar to the embodiment illustrated in FIG. 1, the elongated member includes a handle 214, a body member 216, two straight and parallel rail members 218 and 220, and a base member 222. In contrast, however, to the previous embodiment, in this embodiment the body member 216 has a V-shaped cross-sectional construction. Again, however, the ball member 12 is supported on the rail members 218 and 220 and can be tossed and caught or just rolled back and forth along the rails.

As illustrated in FIG. 7, the handle 214 of the elongated member 210 can also include a decorative or ornamental design. In the embodiment illustrated, the handle 214 includes a V-shaped 226 design. Of course, other designs may be utilized.

FIG. 8 illustrates another preferred embodiment of the elongated member 310 of the present invention. As illustrated in FIG. 8, the elongated member 310 includes a handle 314 and a body member 316 having an S-shape. To this end, the body member includes rails 318, 320, 321, and 322. As illustrated, although rails 318 and 321 and 320 and 322 are parallel to each other, they do not have an identical shape. Again, however, the rail members 318 and 321 and 320 and 322 function to support the ball 16 and may be utilized to catch and toss the ball or to roll the ball up and down the rail members. Due to its construction, the elongated member 310 provides two tossing, manipulating and catching surfaces.

FIG. 10 illustrates another preferred embodiment of the elongated member 410 of the present invention. As illustrated, the elongated member 410 includes a handle 414 and a body member 416. The body member 416 includes, however, 5 rail members 418, 420, 421, 423, and 425 and five corresponding base members 422, 432, 442, 452, and 462. Each pair rail members 418, 420, 421, 423, and 425 defines a support plane and tossing, manipulating and catching surface. Accordingly, as illustrated in FIG. 11, the elongated member 410 has a body member 416 that has a star-shaped cross-sectional construction.

The elongated member 410, as illustrated in FIG. 11, therefore provides five different surfaces on which the ball member 12 may be balanced, caught, or tossed. As can be seen, this provides many variations on the game to be discussed hereinafter.

Figure 28:
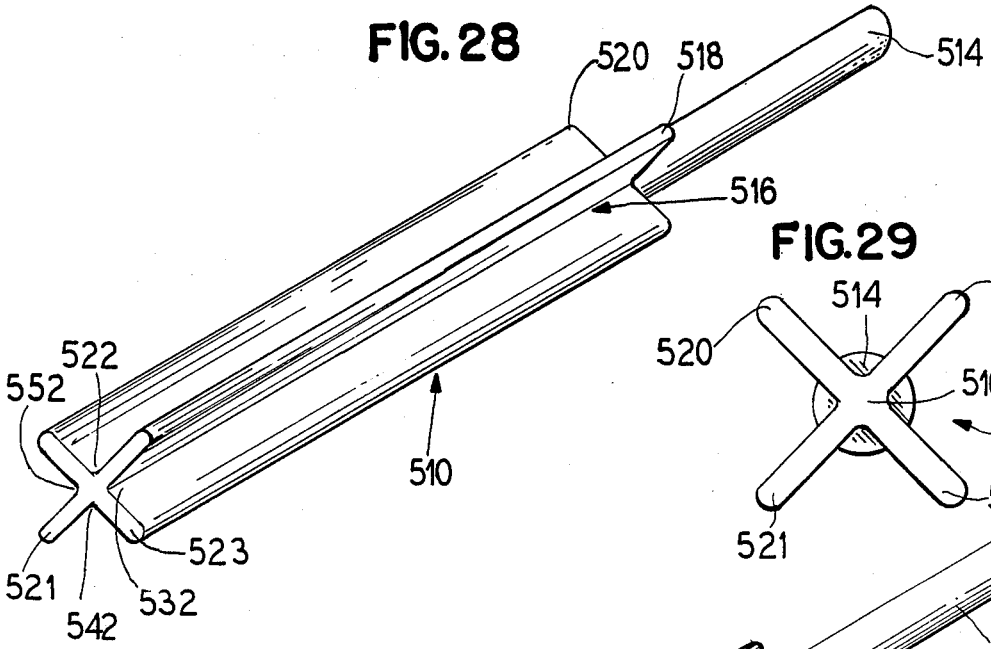
FIG. 28 illustrates a top elevational view of another preferred embodiment of the elongated member of the present invention.

FIG. 28 illustrates another preferred embodiment of the elongated member 510 of the present invention. As illustrated the elongated member 510 includes a handle 514 and a body member 516. The body member 516 includes, however, 4 rail members 518, 520, 521, and 523, and four corresponding base members 522, 532, 542, and 552. Each pair of rail members 518, 520, 521, and 523 defines a support plane and tossing, manipulating and catching surface. Accordingly, as illustrated in FIG. 29, the elongated member 510 has a body member 516 that has a cross-shaped cross-sectional construction.

Figure 29:
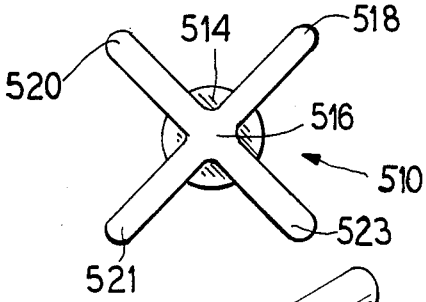
FIG. 29 illustrates a front view of the elongated member of FIG. 28.

The elongated member 510, as illustrated in FIG. 29, therefore provides four different surfaces on which the ball member 12 may be balanced, caught, or tossed. As can be seen, this provides many variations on the games to be discussed hereinafter.

Figure 30:
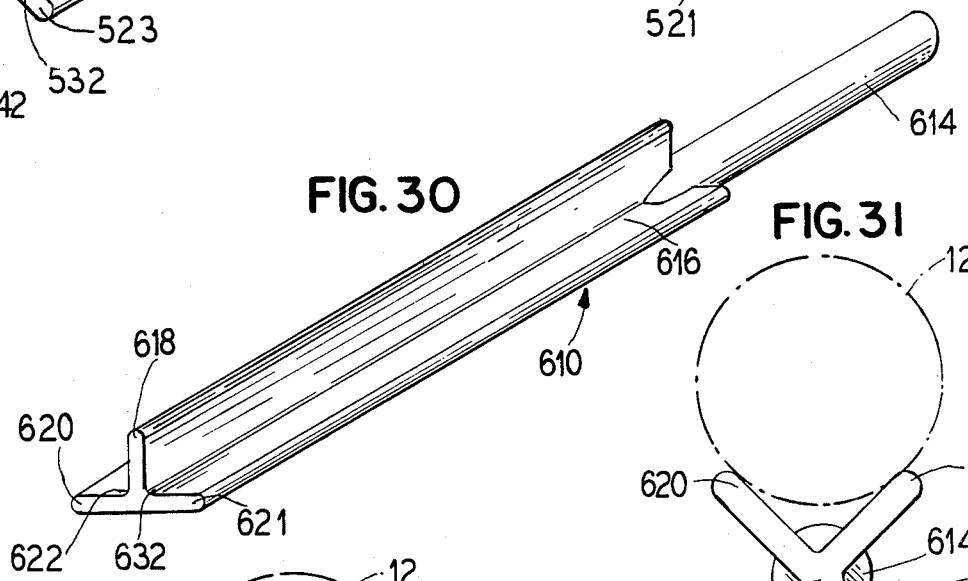
FIG. 30 illustrates another preferred embodiment of the elongated member of the present invention.

FIG. 30 illustrates another preferred embodiment of the elongated member 610 of the present invention. As illustrated the elongated member 60 includes a handle 614 and a body member 616. The body member 616 includes, however, three rail members 618, 620, and 621 and two corresponding base members 622, and 632. Each pair of rail members 618, 620, and 621 defines a support plane and tossing, manipulating and catching surface. Accordingly, as illustrated in FIG. 31, the elongated member 610 has a body member 616 that has a T-shaped cross-sectional construction.

Figure 31:
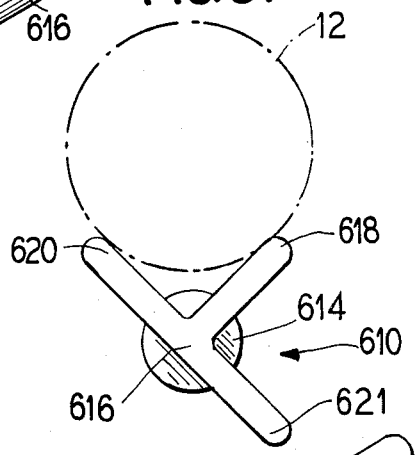
FIG. 31 illustrates a front view of the apparatus of FIG. 30.
Figure 33:
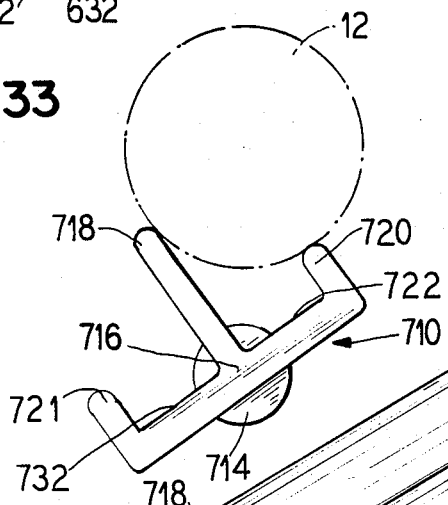
FIG. 33 illustrates a front view of the apparatus of FIG. 32.

The elongated member 610, as illustrated in FIG. 31, therefore provides two different surfaces on which the ball member 12 may be balanced, caught, or tossed. As can be seen, this provides many variations on the games to be discussed hereinafter.

Figure 32:
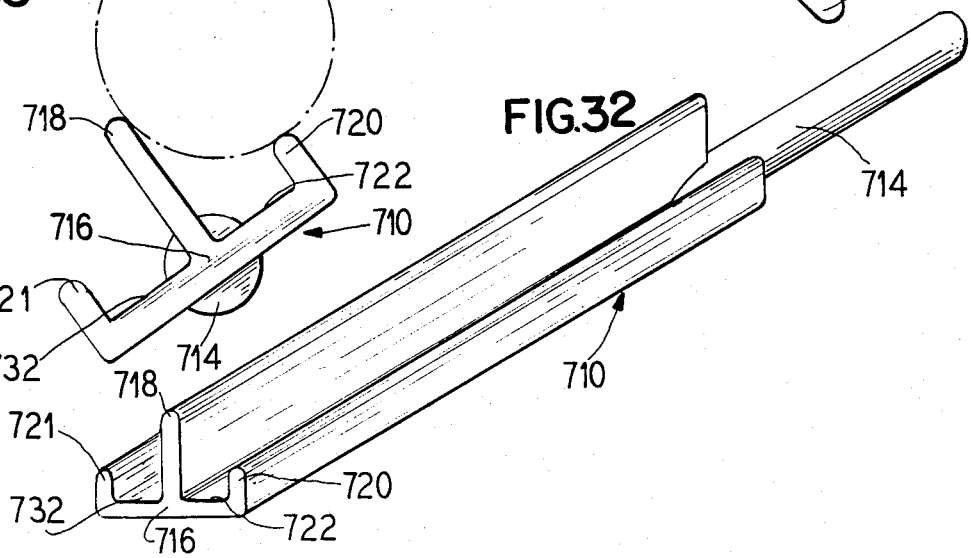
FIG. 32 illustrates another preferred embodiment of the elongated member of the present invention.

FIG. 32 illustrates another preferred embodiment of the elongated member 710 of the present invention. As illustrated the elongated member 710 includes a handle 714 and a body member 716. The body member 716 includes, however, three rail members 718, 720, and 721 and two corresponding base members 722, and 732. Each pair of rail members 718, 720, and 721 defines a support plane and tossing, manipulating and catching surface. Moreover, in contrast to the previous discussed embodiment, the rail members 718, 720 and 721 are not of the same construction. Due to their construction, the elongated member 710 provides differing degrees of difficulty. Moreover, this construction affords variations to the games to be discussed. Accordingly, as illustrated in FIG. 32, the elongated member 710 has a body member 716 that has an E-shaped cross-sectional construction.

The elongated member may be constructed from wood, plastic, aluminum, or other material. The ball member 12 may be constructed from a rubber, such as a natural rubber or synthetic rubber, plastic, or other material. The ball member 12 may either have a smooth or dimpled surface. The elongated member 10 and ball member 12 can be color coded to denote which ball 12 is to be used with which elongated member. Of course, the balls can be constructed so they are interchangeable.

An example of an elongated member 10 and ball member 12 that has been found to work satisfactorily is as follows. The elongated member 10 has a total length of 12 inches with a handle having a 4 inch length and $\frac{5}{8}$ inch diameter. The body member 16 of the elongated member 10 has a length of 8 inches and the distance between the rail members 18 and 20 is $1\frac{1}{8}$ inch. The ball member is constructed from a high bounce rubber and has a $1\frac{3}{4}$ inch diameter.

FIGS. 12–27 illustrate examples of games that may be played utilizing the elongated member 10 and ball member 12 of the present invention. Each of the games provides differing levels of difficulty. The elongated member will be referred to as elongated member 10, however any of the preferred embodiments of the elongated member set forth above may be utilized to play the games discussed below.

Generally, the game or toy of the present invention is designed to be played or manipulated with varying degrees of dexterity or skill. Moreover, with adequate practice, the skills of the user may be increased to different levels so that the device can be artfully applied to different exercises. If successfully applied, the user may compare his skills to those of other users and may test his own level of skill by performing exercises requiring different degrees of dexterity and skill.

Figure 12:
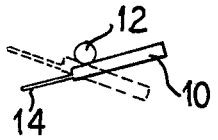
FIG. 12 illustrates how the ball member can be balanced on the elongated member.

As illustrated in FIG. 12, a first level exercise for a single player is depicted wherein the ball member 12 may be rolled up and down the elongated member 10. This is accomplished by tilting the elongated member 10 down and up causing the ball member 12 to roll selectively on the rails 18 and 20. Within each level of exercise, there may be at least three permutative degrees of skill exhibited. For example, at Level I, permutation (a) would be balance; (b) stabilize the ball while alternatively tipping the wand; (c) see-saw the ball through a prescribed path.

Figure 13:
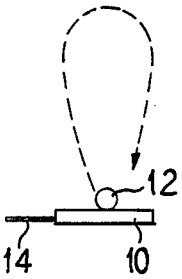
FIG. 13 illustrates how the ball member can be caught by the elongated member.

As illustrated in FIG. 13, a second level exercise for a single player is depicted wherein the ball member 12 may be caught by the elongated member 10. This is accomplished by moving the handle 14 upwardly causing the ball to leave the rails 18 and 20 and then the ball can be caught on the rails 18 and 20. Within Level II, three permutations of skill would be reflected by (a) a single toss; (b) a toss high enough to be characterized as a "test flight"; and (c) repetitive up-and-down.

Figure 17:
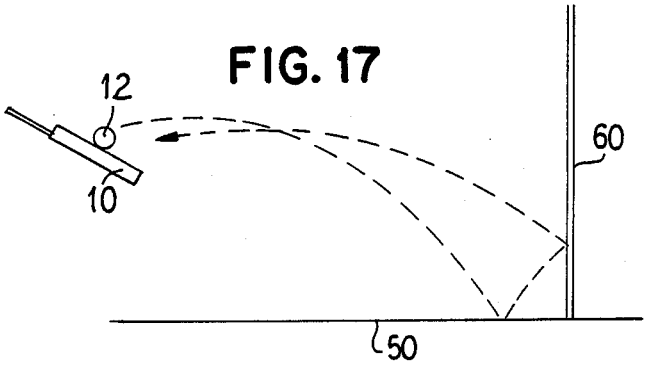
Figure 18:
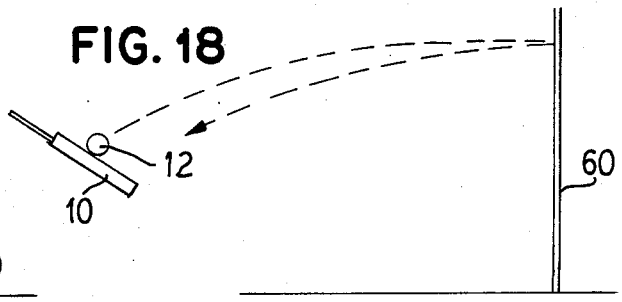
Figure 19:
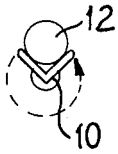
FIGS. 19 and 20 illustrate how the ball member can be supported on the elongated member as the elongated member is rotated.
Figure 20:
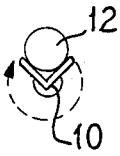
Figure 21:
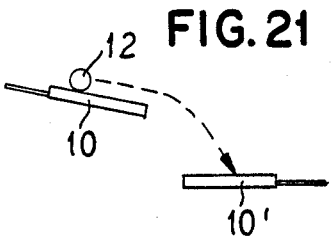
FIGS. 21–27 illustrate how more than one elongated member can be utilized to play different games.
Figure 25:
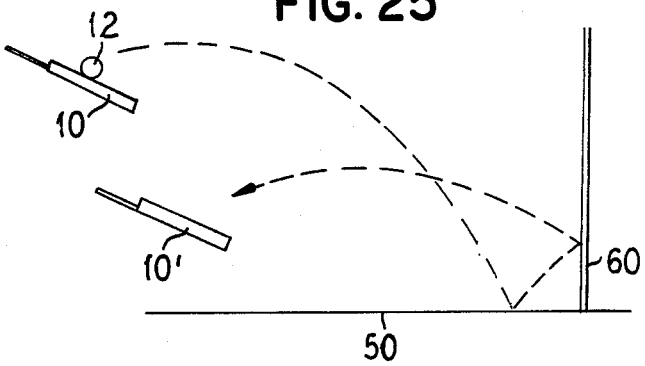
Figure 22:
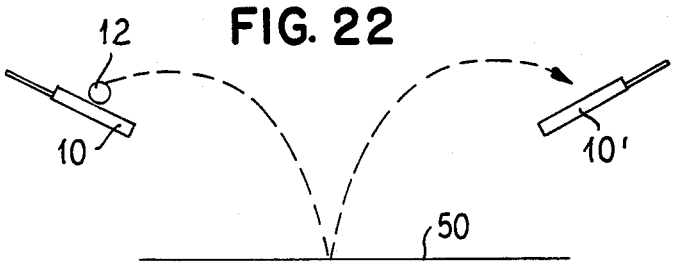
Figure 26:
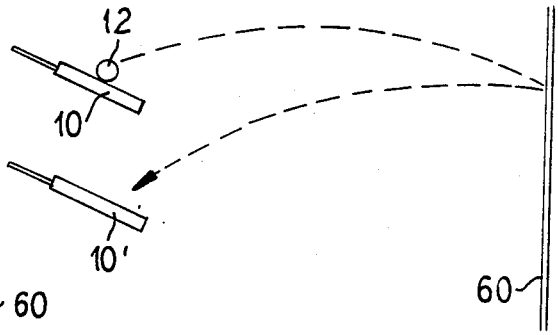
Figure 23:
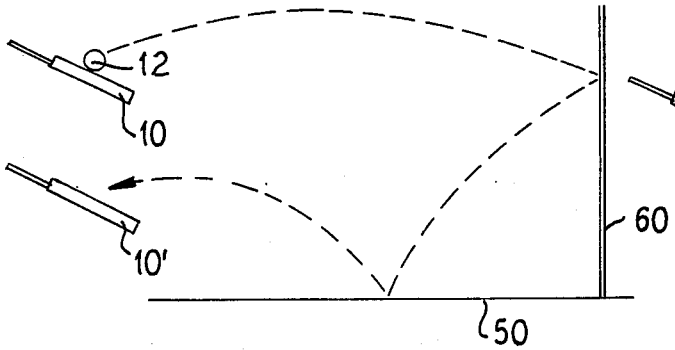
Figure 24:
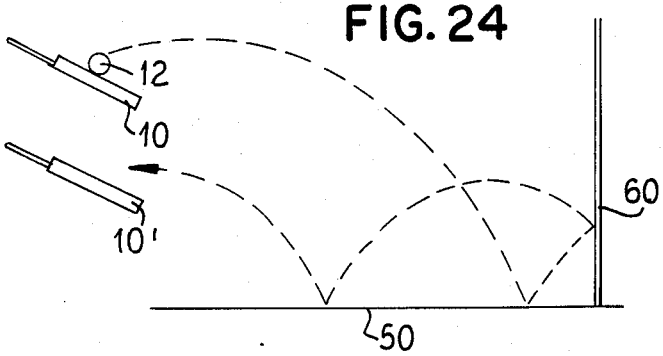
Figure 27:
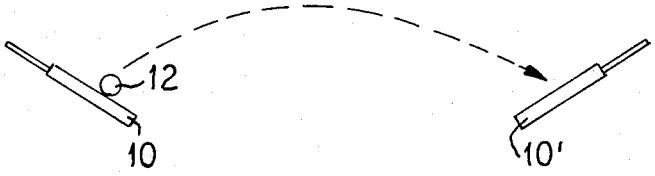

FIGS. 12 through 18 inclusive represent Level I through Level VII for a single player while FIGS. 19 and 20 together illustrate a Level VIII exercise.

Figure 14:
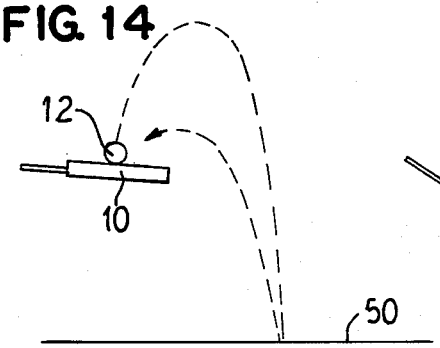
FIG. 14 illustrates how the ball member can be bounced and caught by the elongated member.

FIG. 14 illustrates another game that may be played utilizing the elongated member 10 of the present invention. In this game the ball 12 is tossed and allowed to strike the ground 50 and then is caught by the elongated member 10. As used herein, ground 50 includes a floor, table, or other surface onto which the ball can be tossed.

Figure 15:
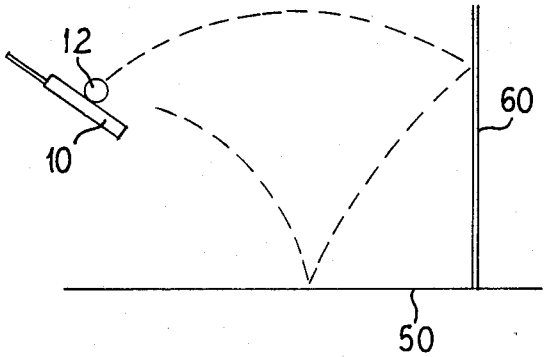

FIG. 15 illustrates another game in which the ball member 12 is tossed by the elongated member 10 off a wall 60 and then onto a ground 50 where it is then caught by the elongated member 10. As used herein, wall 60 includes any vertical structure against which the ball 12 can be tossed.

Figure 16:
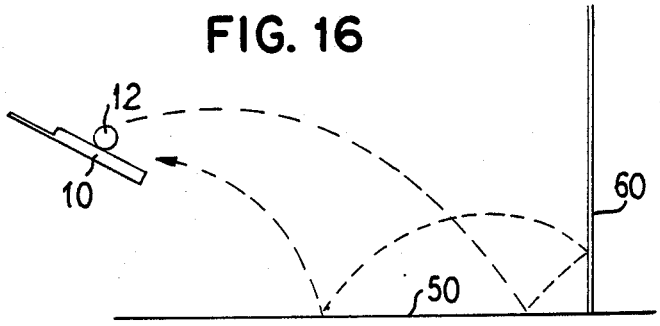
FIGS. 15–18 illustrate different methods for bouncing the ball member off the wall and catching the ball member with the elongated member.

FIG. 16 illustrates another game in which the ball member 12 is tossed by the elongated member 10 against a wall 60 and is allowed to bounce on the ground 50 before the wall and then bounce on the ground again after it hits the wall. The ball is then caught by the elongated member 10.

FIGS. 17 and 18 illustrate other variations of the toss game with the ball being tossed off a wall 60.

FIGS. 19 and 20 illustrate a game in which the ball member 12 is maintained between the rail members 18 and 20 while the elongated member 10 is rotated in either a clockwise or counterclockwise direction.

FIGS. 21 through 27 inclusive represent Level IX through Level XV in terms of skill level and are illustrative of games that can be played by two players in cooperative association with one another, or competitively. Again, each individual exercise can represent different permutative degrees of skill within the depicted level of skill. To this end, two or more sticks or elongated members 10 and 10' are utilized. As illustrated in FIGS. 21 through 27, the ball 12 can either be tossed and caught between the two sticks or elongated members 10 and 10' or the ball 12 can be projected against or bounced off a wall and the players can alternate who catches the ball 12.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A hand manipulated toy for the exercise of coordinated engagement with a spherical ball comprising:

a stick sized and shaped to have a handle to be grasped in the hand of a user and an elongated configuration and providing at least two parallel spaced apart rails extending longitudinally from such handle and affording point contact engagement with the peripheral surface on the ball, the stick including a base member coextensive between the rails, supporting the peripheral surface of the ball so that only the rails contact the ball allowing the ball to roll off either a front end or back end of the stick;

thereby forming an inherently unstable contact engagement between the ball and the stick which may be selectively varied by the exercise of skill and dexterity of the user.

2. An apparatus for providing entertainment comprising:

a spherical object member;

an elongated member including a handle and at least two parallel rail means for catching and tossing the object member, the two rail means being secured to an end of the handle;

the object member and elongated member cooperating so that the object member is only supported on the rail means, having the ability to roll off either a front or back end of the elongated member, and can be tossed and caught by the rail means; and the elongated member includes a base member coextensive between the rail means, the rail means cooperate to support the object member above the base member.

3. The apparatus of claim 2 wherein the base member has a V-shaped construction.

4. The apparatus of claim 2 wherein the base member has a semi-circular construction.

5. The apparatus of claim 2 wherein the elongated member includes five rail means and has a star cross-sectional shape.

6. The apparatus of claim 2 wherein the elongated member includes four rail members and has an X-shaped cross-section.

7. The apparatus of claim 2 wherein the elongated member includes three rail members and has a T-shaped cross-section.

8. The apparatus of claim 2 wherein the body member has an E-shaped cross-sectional construction.

9. The apparatus of claim 2 wherein the rail members are parallel but do not have the same cross-sectional shape.

10. The apparatus of claim 2 wherein the body member has an S-shaped cross-sectional construction.

11. An apparatus for playing a game comprising:

a ball member;

an elongated member including a handle and a body member extending from the handle, the body member including at least two straight, not tapered or curved parallel rail members and a base member coextensive between the rail members, the two rail members defining a support plane for supporting the ball above the base; and the ball member and elongated member being so constructed and arranged that the ball member when supported in the support plane on the rail members is in an inherently unstable contact engagement for the entire length of the support plane with no rest positions allowing the ball to roll off either a front end or a rear end of the elongated member and can be rendered more or less stable by the exercise of skill and dexterity of the user and allowing the ball to be propelled by a movement of the handle and can subsequently be caught by the elongated member.

12. The apparatus of claim 11 wherein the body member has an S-shaped cross-section.

13. The apparatus of claim 11 wherein the rail members define at least three support planes.

14. The apparatus of claim 11 wherein the body member has a V-shaped cross-section.

15. The apparatus of claim 11 wherein the body member has a semi-circular cross-sectional shape.

16. The apparatus of claim 13 wherein the body member has a star-shaped cross-sectional construction.

17. The apparatus of claim 13 wherein the body member has an X-shaped cross-section.

18. The apparatus of claim 11 wherein the body member has a T-shaped cross-section.

19. The apparatus of claim 11 wherein the body member has an E-shaped cross-sectional construction.

20. The apparatus of claim 11 wherein the ball is constructed from a material selected from the group consisting of natural rubber, synthetic rubber, and plastic, and the elongated member is selected from the group consisting of plastic, wood, or aluminum.

21. The apparatus of claim 11 wherein the elongated member and ball member are color coded.

22. A method of playing a game comprising the steps of:

providing an elongated member having a handle and at least two rail members that define a tossing, manipulating and catching surface, a base coextensive between the rail members, and an object ball;

supporting the ball on the rail members above the base so that the ball is in unstable contact above the base for an entire length of an entire plane defined by the rails allowing the ball to roll off either a front or a rear end of the elongated member; and rendering more or less stable the ball by the exercise of skill and dexterity of the user.

23. The method of claim 22 including the steps of:

tossing the ball in the air;

allowing the ball to fall to the ground;

allowing the ball to bounce off the ground; and catching the ball on the tossing, manipulating and catching surface of the elongated member.

24. The method of claim 22 including the steps of:

tossing the ball in the air; and catching the ball on the tossing, manipulating and catching surface of the elongated member.

25. The method of claim 22 including the steps of:

tossing the ball towards a wall;

allowing the ball to bounce off the wall; and catching the ball on the tossing, manipulating and catching surface of the elongated member.

26. The method of claim 22 including the steps of:

providing a second elongated member having a handle and at least two rail members that define a tossing, manipulating and catching surface;

tossing the ball in the air; and catching the ball on the tossing, manipulating and catching surface of the second elongated member.

27. The method of claim 22 including the steps of:

manipulating the ball on the toss, manipulating, and catching surface.

* * * * *